US005742938A

United States Patent [19]

Winningham et al.

[11] Patent Number: 5,742,938

[45] Date of Patent: Apr. 28, 1998

[54] BATTERS' SHIN AND ANKLE GUARD

[75] Inventors: Matt Winningham, Maryland Heights; Matthew S. McNamara, St. Louis, both of Mo.

[73] Assignee: Rawlings Sporting Goods Company, Inc., St. Louis, Mo.

[21] Appl. No.: 764,613

[22] Filed: Dec. 11, 1996

[51] Int. Cl.[6] ..... A41D 13/00

[52] U.S. Cl. ..... 2/22

[58] Field of Search ..... 2/22, 24, 61, 23, 2/16, 62, 242; 602/23, 26, 27, 65, 16, 20

[56] References Cited

U.S. PATENT DOCUMENTS

| | | | |
|---|---|---|---|
| D. 361,869 | 8/1995 | Paffett et al. | D29/120 |
| 1,136,307 | 4/1915 | Bourdon . | |
| 1,777,088 | 9/1930 | Horath . | |
| 2,717,387 | 9/1955 | McMahan | 2/22 |
| 2,733,443 | 2/1956 | Holder | 2/22 |
| 2,982,968 | 5/1961 | Groot | 2/22 |
| 3,135,964 | 6/1964 | Pender | 2/22 |
| 3,465,364 | 9/1969 | Edelson | 2/22 |
| 3,533,106 | 10/1970 | Kremp | 2/22 |
| 3,703,171 | 11/1972 | Shiavitto | 128/80 |
| 3,898,697 | 8/1975 | Whitehead | 2/22 |
| 4,066,074 | 1/1978 | Keller | 128/89 |
| 4,144,592 | 3/1979 | Larson | 2/22 |
| 4,354,280 | 10/1982 | Hayes | 2/16 |
| 4,409,689 | 10/1983 | Buring et al. | 2/22 |
| 4,484,360 | 11/1984 | Leighton et al. | 2/22 |
| 4,494,534 | 1/1985 | Hutson | 602/23 |
| 4,497,070 | 2/1985 | Cho | 2/22 |
| 4,608,718 | 9/1986 | Reed | 2/22 |
| 4,627,108 | 12/1986 | Järvinen | 2/22 |
| 4,633,529 | 1/1987 | Litz | 2/22 |
| 4,665,562 | 5/1987 | Winer | 2/22 |
| 4,669,126 | 6/1987 | Jones | 2/22 |
| 4,674,157 | 6/1987 | Litz | 24/442 |
| 4,692,946 | 9/1987 | Jurga | 2/22 |
| 4,700,406 | 10/1987 | Meistrell | 2/22 |
| 4,715,067 | 12/1987 | Beauregard | 2/22 |
| 4,751,748 | 6/1988 | Ekins | 2/22 |
| 4,868,926 | 9/1989 | Lowson | 2/22 |
| 4,884,561 | 12/1989 | Letson, Sr. | 128/77 |
| 4,888,826 | 12/1989 | Parsons, Jr. et al. | 2/22 |
| 4,967,493 | 11/1990 | Mues | 36/72 R |
| 4,999,847 | 3/1991 | Barcelo | 2/24 |
| 5,031,607 | 7/1991 | Peters | 602/27 |
| 5,044,360 | 9/1991 | Janke | 602/27 |
| 5,056,158 | 10/1991 | Lutz | 2/22 |
| 5,135,473 | 8/1992 | Epler et al. | 602/62 |
| 5,301,370 | 4/1994 | Henson | 2/22 |
| 5,452,475 | 9/1995 | Hunt, Jr. | 2/22 |
| 5,507,720 | 4/1996 | Lampropoulas | 602/27 |

FOREIGN PATENT DOCUMENTS

| | | | |
|---|---|---|---|
| 16488 | 2/1934 | Australia | 2/22 |
| 949256 | 6/1974 | Canada . | |
| 1935278 | 1/1971 | Germany . | |
| 2310149 | 9/1974 | Germany . | |
| 2362044 | 6/1975 | Germany . | |
| 2646529 | 5/1977 | Germany . | |
| 2607628 | 9/1977 | Germany . | |
| 2658050 | 6/1978 | Germany . | |
| 2847866 | 5/1980 | Germany . | |
| 1437599 | 5/1976 | United Kingdom . | |
| 1556357 | 11/1979 | United Kingdom . | |
| 1561252 | 2/1980 | United Kingdom . | |

*Primary Examiner*—Amy B. Vanatta
*Attorney, Agent, or Firm*—Stinson, Mag & Fizzell

[57] ABSTRACT

A shin and ankle guard for attachment to a baseball or softball batter's leg to protect the shin, ankle and upper foot from foul tips and pitched balls has a rotatable ankle portion to protect either the inside portion or the outside portion of the ankle depending on the batter's needs. This allows both right-handed and left-handed batters of the same team to use the same guard. The guard comprises a shin portion having a first rigid shell shaped to fit on an anterior surface of a shin of a leg and a first pad affixed to the first rigid shell between the first rigid shell and the leg; at least one strap securable around the leg to hold the shin portion in place; a foot portion having a second rigid shell shaped to fit on the anterior surface of the foot and a second pad affixed to the second rigid shell between the second rigid shell and the foot; and an ankle portion having a third rigid shell shaped to fit on the ankle and which is rotatable to allow the ankle portion to swing to a left position or a right position.

14 Claims, 1 Drawing Sheet

BATTERS' SHIN AND ANKLE GUARD

FIELD OF THE INVENTION

The present invention relates generally to a protective leg guard and, in particular, to a protective guard for shielding the shin, ankle and upper foot of the type used by baseball or softball batters to prevent injuries from foul tips or pitched balls.

BACKGROUND OF THE INVENTION

Using a round bat to hit a round ball crossing the "dish" (i.e., home plate) at speeds of up to 100 miles per hour takes exceptional skill. This is why a batter who hits safely 30% of the time is considered a "great hitter." In attempts to improve such skills, ball players spend countless hours practicing the hitting game, the part which requires the highest degree of concentration. Nagging injuries, of course, can distract a player, particularly those from foul tips which strike the shin, ankle or foot. The use of leg guards by batters and baseball catchers is well known to protect the interior and lateral portions of the legs from thrown or batted balls, from bats, and from other players and their cleats in running the bases. Flexibility and comfort, as well as adequate protection, is important so as to not interfere with the batter's concentration and playing performance.

The leg and shin guards of the prior art particularly expose the ankle to foul tips, pitched balls, cleats and baseball or softball bats. Further, right handed, left-handed, or switch hitting batters often share the same shin guard among those on their team. Consequently, a need exists for a detachable batter's shin and ankle guard having an ankle pad with rotation means to allow a batter to adjust the ankle pad to suit his/her needs for protection.

SUMMARY OF THE INVENTION

The objects of the invention are as follows:

(a) To provide a device for batting practice and actual games for protecting the shin, ankle and upper foot from blows from foul tips, pitched balls, baseball or softball bats and other players and their cleats in running the bases;

(b) to provide a device protecting the shin, ankle and upper foot having an ankle pad that can be adjusted into either a right position or a left position so that right-handed, left-handed or switch hitting batters can use the same guard to protect his/her ankle from either side of home plate; and (c) to provide a device for protecting the shin, ankle and upper foot from blows which is comfortable to wear, flexible enough so as not to inhibit batting and running performance and is easily donned and removed.

According to the invention, there is provided a device attachable to a shin, ankle and foot for protecting the same from blows comprising: a shin portion having a first rigid shell shaped to fit on an anterior surface of the shin; at least one strap securable around the leg to hold the shin portion in place on the leg; a foot portion having a second rigid shell shaped to fit on the upper surface of the foot; and an ankle portion having a third rigid shell shaped to fit on an ankle and having rotation means which allows the ankle portion to rotate to a left position or a right position so that a wearer can adjust the ankle portion to suit his/her needs for protection.

BRIEF DESCRIPTION OF THE DRAWINGS

The embodiments of the invention will now be described with reference to the accompanying drawings in which.

DETAILED DESCRIPTION OF THE INVENTION

Figure 1:
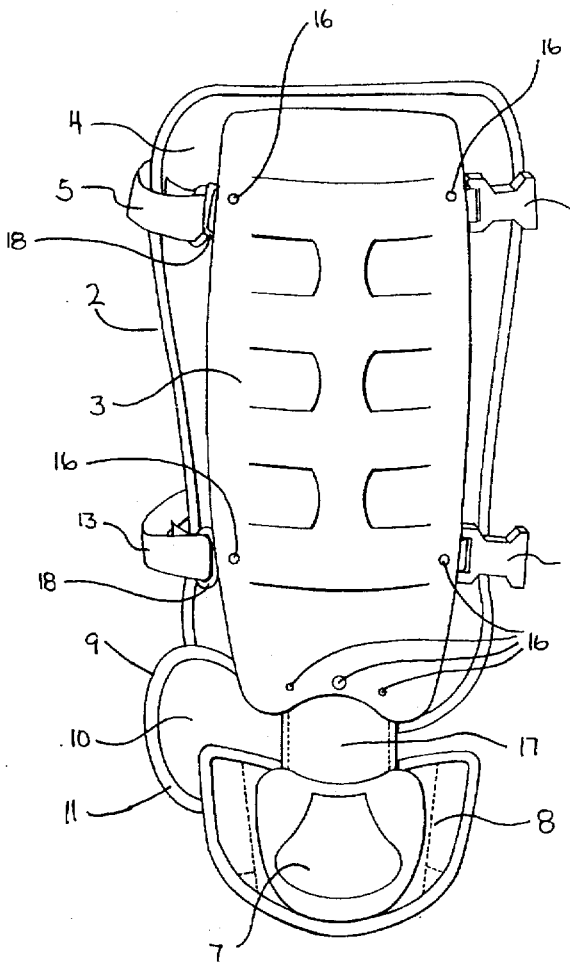
FIG. 1 is a front elevational view of the invention.
Figure 2:
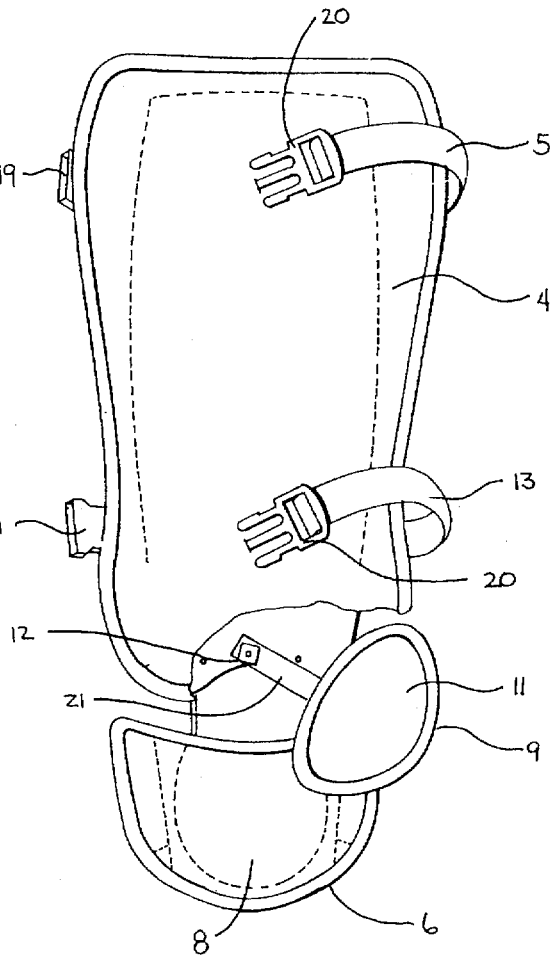
FIG. 2 is a rear elevational view of the invention with the lower portion of the shin pad cut away to show the rotation means and arm which allow the ankle portion to be rotated to a right or left position.

Referring to FIGS. 1 and 2, a shin and ankle guard i for attachment to a baseball or softball batter's leg to protect the shin, ankle and upper foot from foul tips and pitched balls generally includes a shin portion 2, a foot portion 6 and an ankle portion 9. The guard 1 is preferably worn on the shin and foot which faces the pitcher in the batting position, since this is the area which is likely to be struck by foul tips and pitched balls. The shin portion 2 has a first rigid shell 3 backed by a first pad 4 which is designed to protect the shin from blows. The foot portion 6 has a second rigid shell 7 backed by a second pad 8 to likewise shield the upper foot from such blows. Ankle portion 9 has a third rigid shell 10, backed by a third pad 11 and an ankle portion rotation means 12 so that a batter can rotate the ankle portion to protect the inner or outer part of the right or left ankle as the batter may prefer. This further allows all batters on one team to share guard 1. Ankle portion 9 is preferably generally circular in shape and is dish shaped to have a concave inner surface to cup about and protect the prominent bump of the ankle bone on the side of the wearer's foot.

First rigid shell 3, second rigid shell 7 and third rigid shell 10 are preferably constructed from relatively rigid plastic material, such as high density polyethylene. First pad 4 is affixed to the first rigid shell 3 by stitching, glueing or other like means and is between the first rigid shell 3 and the leg of the wearer. Second pad 8 and third pad 11 are likewise affixed to second rigid shell 7 and third rigid shell 10, respectively. This way, direct impact pressure is distributed broadly and not directly transmitted through the padding. First pad 4, second pad 8 and third pad 11 are preferably formed of expanded polyurethane or cross-link polyethylene or simply a soft rubber foam and are preferably encased in a thin, though resilient, covering of semi-elastic nylon material. The pads are then sewn or glued in place, as is conventional in the art. Additionally, the peripheral edges of pads 4, 8 and 11 are preferably finished with thin strips of material to protect the edges from wear and tear.

A plurality of metallic loops 18 are connected to the first rigid shell 3 by sandwiching loops 18 between shell 3 and pad 4 and then riveting them by selected ones of the rivets 16. Loops 18 may also be made of a rigid plastic material or other suitable material capable of withstanding blows. Likewise, plastic female couplers 19 are sandwiched between shell 3 and pad 4 and riveted to shell 3 with rivets 16. Each end of nylon/elastic first strap 5 and second strap 13 are then looped through loops 18. Opposite ends of straps 5 and 13 each have a male clip 20 which mate with its corresponding female coupler 19 to securely and adjustably connect the guard 1 to the wearer's leg.

Connector means generally designated as 17 are provided for articulately connecting the foot portion 6 and shin portion 2. Connector means 17 may be simply a piece of foam padding having a plastic skin cover and binding sewn along longitudinal edges thereof. Means 17, therefore, functions both to provide articulation and protection to the forward portion of the user's leg in the vicinity of the foot, ankle and lower shin. Means 17 is preferably sandwiched between shells 3 and 7 and associated pads 4 and 8 and connected thereat by rivets 16.

Rotation means generally designated as 12 are provided to not only allow for the rotation of ankle portion 9 to a left or right position but also to affix the ankle portion 9 to shin portion 2. Additionally, rotation means 12 allows the device to be worn on either leg of the ball team's members. Ankle portion 9 is attached to rotation means 12 and, hence, shin portion 2, by way of arm 21. Arm 21 is comprised of relatively rigid plastic or vinyl and is preferably an extension of the same material as ankle portion 9 so as to form a uniform piece. Alternatively, arm 21 can be affixed by conventional methods at one end to ankle portion 9 and rotation means 12 at the other end. Arm 21 is of sufficient length so that ankle portion 9 corresponds to and covers the ankle. Rotation means 12 can be constructed of anything that will attach ankle portion 9 to shin portion 2 while allowing ankle portion 9 to rotate. Preferably, a T-nut is employed of which the bolt is inserted through holes in shell 3, pad 4 and arm 21 and which the nut is hand tightened to allow the desired rotation.

Although other modifications and changes may be suggested by those skilled in the art, it is the intention of the inventor to embody within the patent warranted hereon all changes and modifications as reasonably and properly come within the scope of his contribution to the art.

What is claimed and desired to be secured by Letters Patent is as follows:

1. A shin and ankle guard for attachment to a leg, comprising:

(a) a shin portion having a first rigid shell shaped to fit on an anterior surface of a shin of a leg;

(b) at least one strap securable around the leg to hold the shin portion in place on the anterior portion of the leg;

(c) a foot portion having a second rigid shell shaped to fit on an anterior surface of a foot;

(d) an ankle portion having a third rigid shell shaped to fit on an ankle of a wearer; and (e) rotation means for rotating said ankle portion to a left position or a right position so that a wearer can adjust said ankle portion to suit his/her needs for protection.

2. A shin and ankle guard for attachment to a leg, comprising:

(a) a shin portion having a first rigid shell shaped to fit on an anterior surface of a shin of a leg;

(b) at least one strap securable around the leg to hold the shin portion in place on the anterior portion of the leg;

(c) a foot portion having a second rigid shell shaped to fit on an anterior surface of a foot; and (d) an ankle portion having a third rigid shell shaped to fit on an ankle of a wearer;

(e) said ankle portion comprising a pad affixed to said third rigid shell between the ankle and the third rigid shell and an arm connected to said ankle portion at a first end and connected to said shin portion at a second end.

3. A shin and ankle guard for attachment to a leg, comprising:

(a) a shin portion having a first rigid shell shaped to fit on an anterior surface of a shin of a leg;

(b) at least one strap securable around the leg to hold the shin portion in place on the anterior portion of the leg;

(c) a foot portion having a second rigid shell shaped to fit on an anterior surface of a foot; and (d) an ankle portion having a third rigid shell shaped to fit on an ankle of a wearer, said ankle portion having an arm connected to said ankle portion at a first end and to said shin portion at a second end.

4. A shin and ankle guard for attachment to a leg, comprising:

(a) a shin portion having a first rigid shell shaped to fit on an anterior surface of a shin of a leg and a first pad affixed to the first rigid shell between the first rigid shell and the leg;

(b) at least one strap securable around the leg to hold the shin portion in place on the anterior surface of the leg;

(c) a foot portion having a second rigid shell shaped to fit on an anterior surface of a foot and a second pad affixed to said second rigid shell between said second rigid shell and the foot;

(d) an ankle portion having a third rigid shell shaped to fit on an ankle and a third pad affixed to said third rigid shell between said third rigid shell and the ankle; and (e) rotation means for rotating said ankle portion to a left position or a right position so that the wearer can adjust said ankle portion to suit his/her needs for protection.

5. The shin and ankle guard of claim 4, wherein said ankle portion is generally circular in shape.

6. The shin and ankle guard of claim 4, wherein said strap is a first connecting strap located at an upper part of the shin portion, said shin and ankle guard further comprising a second connecting strap located at a lower part of the shin portion.

7. A shin and ankle guard for attachment to a leg, comprising:

(a) a shin portion having a first rigid shell shaped to fit on an anterior surface of a shin of the leg and a first pad affixed to said first rigid shell between said first rigid shell and the leg;

(b) at least one strap securable around the leg to hold said shin portion in place on the anterior surface of the leg;

(c) a foot portion having a second rigid shell shaped to fit on an anterior surface of a foot and a second pad affixed to said second rigid shell between said second rigid shell and the foot;

(d) an ankle portion having a third rigid shell shaped to fit on an inside portion or an outside portion of an ankle and a third pad affixed to said third rigid shell between said third rigid shell and said inside or outside portions of the ankle; and (e) rotation means for rotating said ankle portion to a left position or a right position so that a wearer can adjust said ankle portion to cover the inside portion or the outside portion of the ankle depending on the wearer's need for protection.

8. The shin and ankle guard of claim 7, wherein said ankle portion is affixed to a bottom portion of the shin portion.

9. The shin and leg guard of claim 7, wherein the ankle portion is affixed to a bottom portion of the shin portion by the rotation means.

10. The shin and leg guard of claim 9, wherein said rotation means is a T-nut fastened to said shin portion through a hole in the shin portion.

11. The shin and leg guard of claim 7, wherein said foot portion is riveted to said shin portion by a plurality of rivets.

12. The shin and ankle guard of claim 7 further comprising a third strap affixed to and between the foot portion and the shin portion.

13. The shin and ankle guard of claim 12 wherein said third strap is made of a semi-rigid material to conform to the shape of an anterior portion between the shin and the foot and which allows the foot portion to be positioned on an anterior portion of the foot.

14. A shin and ankle guard for attachment to a leg comprising:

(a) a shin portion having a first rigid shell shaped to fit on an anterior surface of a shin of a leg in a first pad affixed to the first rigid shell between the first rigid shell in the leg;

(b) at least one strap securable around the leg to hold the shin portion in place on the anterior surface of the leg;

(c) a foot portion having a second rigid shell shaped to fit on an anterior surface of a foot in a second pad affixed to said second rigid shell between the second rigid shell and the foot, said foot portion being connected to the shin portion by wide strap made of a semi-rigid material to conform to the shape of an anterior portion between the shin and the foot and which allows the foot portion to be positioned on an anterior portion of the foot;

(d) an ankle portion having a third rigid shell shaped to fit on an ankle and a third pad affixed to said third rigid shell between said third rigid shell and the ankle, said ankle portion having rotation means for rotating said ankle portion to a left position or a right position so that a wearer can adjust said ankle portion to suit his/her needs for protection.

* * * * *

UNITED STATES PATENT AND TRADEMARK OFFICE

CERTIFICATE OF CORRECTION

PATENT NO. : 5,742,938

DATED : April 28, 1998

INVENTOR(S) : Matt Winningham and Matthew S. McNamara

It is certified that error appears in the above-indentified patent and that said Letters Patent is hereby corrected as shown below:

In column 2, line 9, of the Patent, delete "i" before "for" and substitute -- 1 -- therefor.

Signed and Sealed this

FourthDay of August, 1998

Bruce Lehman

*Attest:*

BRUCE LEHMAN

*Attesting Officer*

*Commissioner of Patents and Trademarks*